US006554146B1

(12) United States Patent
DeGroff et al.

(10) Patent No.: US 6,554,146 B1
(45) Date of Patent: Apr. 29, 2003

(54) SINGLE SERVE PLASTIC CONTAINER AND PACKAGE INCORPORATING SAME

(75) Inventors: Jamie W. DeGroff, Perrysburg, OH (US); Rolf C. Myers, Graytown, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 10/052,050

(22) Filed: Jan. 17, 2002

(51) Int. Cl.[7] ..... B65D 1/02; B65D 23/00; B65D 23/08

(52) U.S. Cl. ..... 215/381; 215/383; 215/12.1; 220/675

(58) Field of Search ..... 215/279, 382–384, 215/381; 220/675

(56) References Cited

U.S. PATENT DOCUMENTS

| | | | | | |
|---|---|---|---|---|---|
| 4,610,366 | A | * | 9/1986 | Estes et al. | 215/383 X |
| 4,877,141 | A | | 10/1989 | Hayashi et al. | |
| 5,103,990 | A | * | 4/1992 | Irwin | 220/276 X |
| 5,122,327 | A | * | 6/1992 | Spina et al. | 215/383 X |
| 5,341,946 | A | | 8/1994 | Vailliencourt et al. | |
| 5,407,086 | A | * | 4/1995 | Ota et al. | 215/383 |
| 5,472,105 | A | | 12/1995 | Krishnakumar et al. | |
| 5,542,557 | A | * | 8/1996 | Koyama et al. | 215/347 |
| 5,560,989 | A | * | 10/1996 | Han | 215/250 X |
| 5,598,941 | A | * | 2/1997 | Semersky et al. | 215/384 |
| 5,704,503 | A | | 1/1998 | Krishnakumar et al. | |
| 5,758,790 | A | * | 6/1998 | Ewing, Jr. | 215/384 |
| 5,971,184 | A | * | 10/1999 | Krishnakumar et al. | 215/384 |
| D422,915 | S | | 4/2000 | Hestehave et al. | |
| 6,044,997 | A | * | 4/2000 | Ogg | 215/384 X |
| 6,105,800 | A | | 8/2000 | Czesak | |
| D445,036 | S | | 7/2001 | Goettner et al. | |

FOREIGN PATENT DOCUMENTS

| | | | |
|---|---|---|---|
| DE | 1432217 | * 12/1968 | 215/384 |

* cited by examiner

*Primary Examiner*—Sue A. Weaver

(57) ABSTRACT

A container (10) for packaging a single serve quantity of a hot-fillable beverage, the container being blown from a multi-layer co-extruded thermoplastic parison and having a generally cylindrical central panel (12) with a spaced plurality of vacuum panels (36) therein and a plain unreinforced bottom (30). The container also has bulbous heel and shoulder portions (14, 16) at opposed ends of the central panel and projecting outwardly therefrom to a protect a double-ended or other label applied to the central panel. The wall of the container has innermost and outermost layers (44, 46) of virgin PPE, a main structural layer (48) of reground like containers with or without virgin PPE mixed therein and positioned in contact with the innermost layer and directly bonded thereto, a layer of an oxygen-barrier material (5), such as EVA, positioned between the structural layer and the outermost layer, and layers of adhesive (52, 54) between the oxygen-barrier layer and the opposed layers and serving to adhesively join the oxygen-barrier layer to the opposed layers. Also, a package made up of a hot-filled container (10) with a sealing film (70) applied to a rim at a free end of a finished portion (20) of the container and a molded plastic or other closure (60) removeably applied to the finish portion of the container.

15 Claims, 5 Drawing Sheets

SINGLE SERVE PLASTIC CONTAINER AND PACKAGE INCORPORATING SAME

FIELD OF THE INVENTION

This invention relates to a blown plastic container that is adapted for the packaging of a single serve quantity of a liquid, and to a package incorporating a filled container of the foregoing character. More particularly, this invention relates to a container of the foregoing character that is suited for the packaging of a juice or other beverage that is introduced into the package while hot, and to a package that is sealed and capped after being filled with such a beverage while the beverage is still hot.

BACKGROUND OF THE INVENTION

U.S. Pat. No. 5,472,105 (Krischnakumar et al.), the disclosure of which is incorporated by reference herein, describes a hot-fillable plastic container that is blown from a preform of a thermoplastic material, specifically, polyethylene teraphetalete (PET), alone or in combination with layers of other materials. The container of the '105 patent is taught as being well-suited for the packaging of beverages in multi-serve quantities, for example, 64 oz. quantities.

While packages of the type described in the aforesaid '105 patent have proven to be quite successful in the packaging of large, multi-serve quantities of hot-filled fruit juices and other beverages, such packages, which often have integral, gripable handles, are unduly complex in configuration to be used for the packaging of a substantially smaller quantity of a hot-filled beverage, for example, a single serve quantity of 8 fl. oz.

BRIEF DESCRIPTION OF THE INVENTION

According to the present invention there is provided a blown plastic container that is well-suited for the packaging of a single serve quantity, for example, 8 oz., of a hot-filled juice or other beverage, and a package that incorporates such a container that is sealed and capped after filling while the beverage is still at an elevated temperature. The container according to the present invention is generally circular in cross-section throughout its vertical extent, except for a plurality of spaced, configured vacuum panels that are disposed in a circular array in a major body portion of the container to accommodate partial collapsing of the wall of the container under a partial vacuum resulting from the cooling of the filled beverage after the container is sealed and capped after filling while the beverage is still hot.

The container of the present invention is preferably molded from a parison or blank that is injection molded with a plurality of layers of thermoplastic materials. Preferably, polypropylene (PPE) is used as the primary material in such an arrangement, with virgin PPE being used both as the radially innermost and radially outermost of such layers, with a mixture of regrind (mostly PPE) and virgin PPE as the main structural layer next to and sealingly joined directly to the radially outermost surface of the radially innermost surface of the virgin PPE layers. Because many beverages to be packaged in blown plastic containers are oxygen-sensitive, a package according to a preferred embodiment of the present invention incorporates an oxygen-barrier material, such as ethylene vinyl alcohol (EVA), between the regrind/virgin PPE layer and the radially outermost PPE layer, with layers of adhesive between the oxygen-barrier layer and the layers adjacent to it to prevent the delamination of layers of the container due to sealing incompatibility between the barrier layer and the opposed PPE layers.

Because a package according to the present invention uses PPE as it main strength-imparting layers, rather than PET, as do many prior art multi-layer hot-fillable beverage containers, it is unnecessary to use a complex bottom structure in such a container, at least for a single serve capacity container, because PPE retains more of its original strength at filling temperatures, typically approximately 180° F., than the cost-competitive grades of PET. Elimination of the bottom sealing ribs typical of blown plastic PET containers for hot-filled beverages reduces the cost of the molds used to blow such containers and helps to reduce the time it takes to manufacture such molds.

Accordingly, it is an object of the present invention to provide a blown plastic container that is well-suited for the packaging of a single serve quantity of a hot-filled liquid, and to provide a package that incorporates such a container that is sealed and capped after filling while the beverage is still hot. More particularly, it is an object of the present invention to provide a container of the aforesaid character, and an associated package, that is well-suited for the packaging of a juice or other beverage that is subject to oxygen-degradation if the container does not incorporate a suitable barrier to migration of oxygen into the container.

For a further understanding of the present invention and the objects thereof, attention is directed to the drawings and the following brief description thereof, to the detailed description of the invention and to the appended claims.

DETAILED DESCRIPTION OF THE PREFERRED EMBODIMENT(S)

Figure 1:
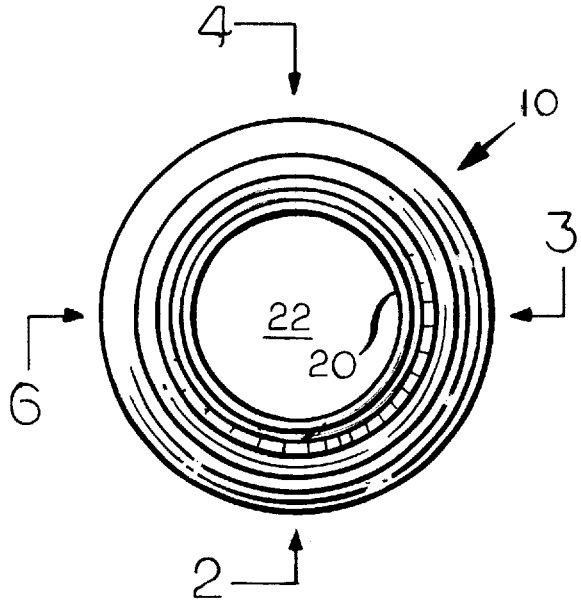
FIG. 1 is a top plan view of a container according to the preferred embodiment of the present invention.
Figure 2:
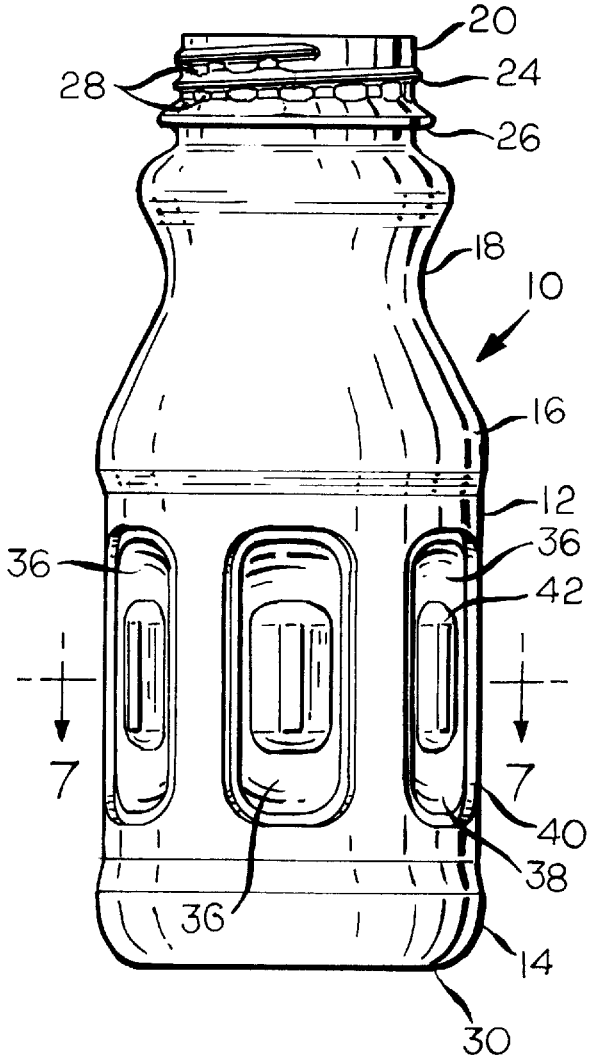
FIGS. 2, 3, 4 and 6 are side elevation views of the container of FIG. 1 taken in the direction of the arrows 2, 3, 4 and 6, respectively, in FIG. 1.
Figure 6:
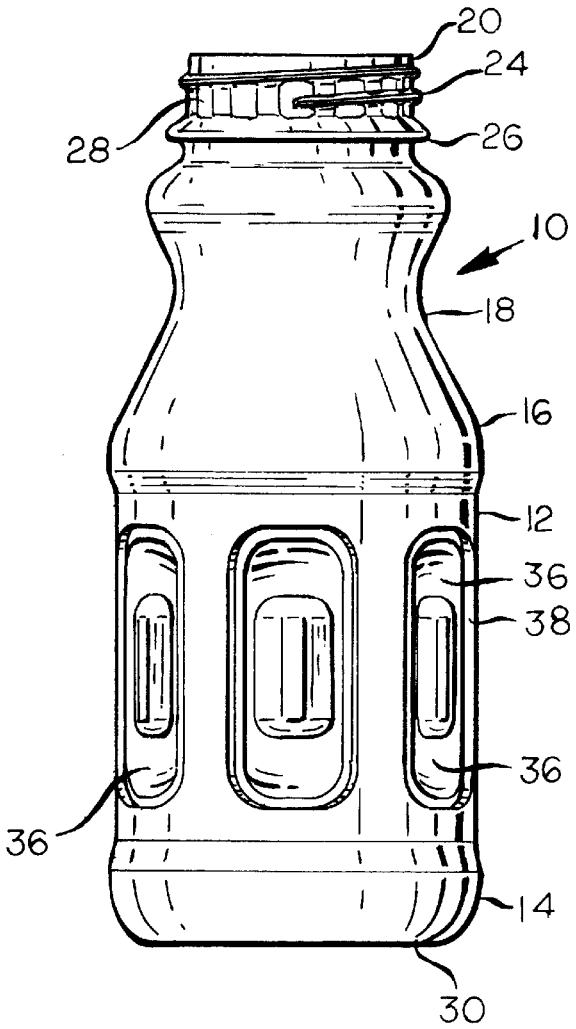
Figure 3:
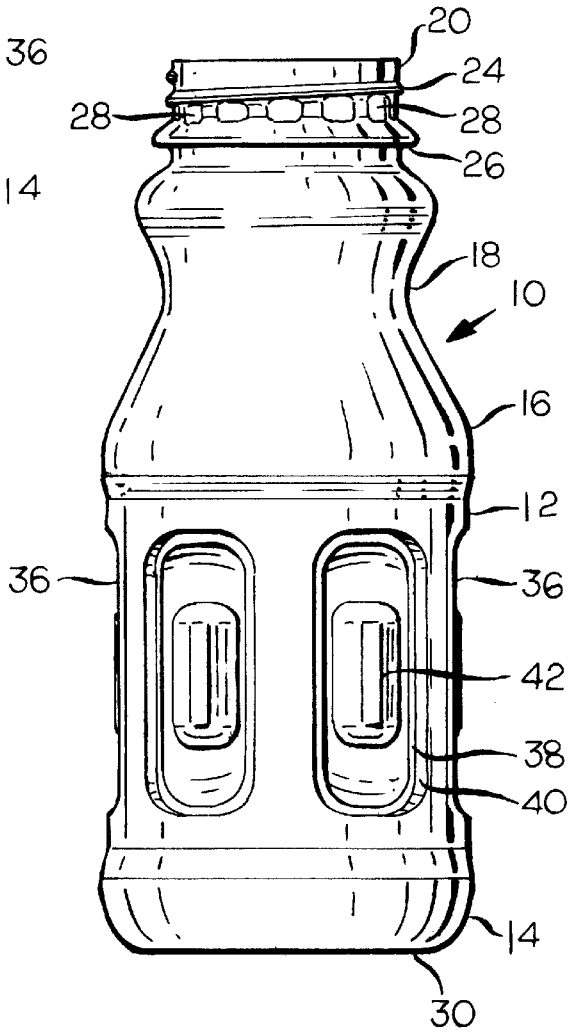
Figure 4:
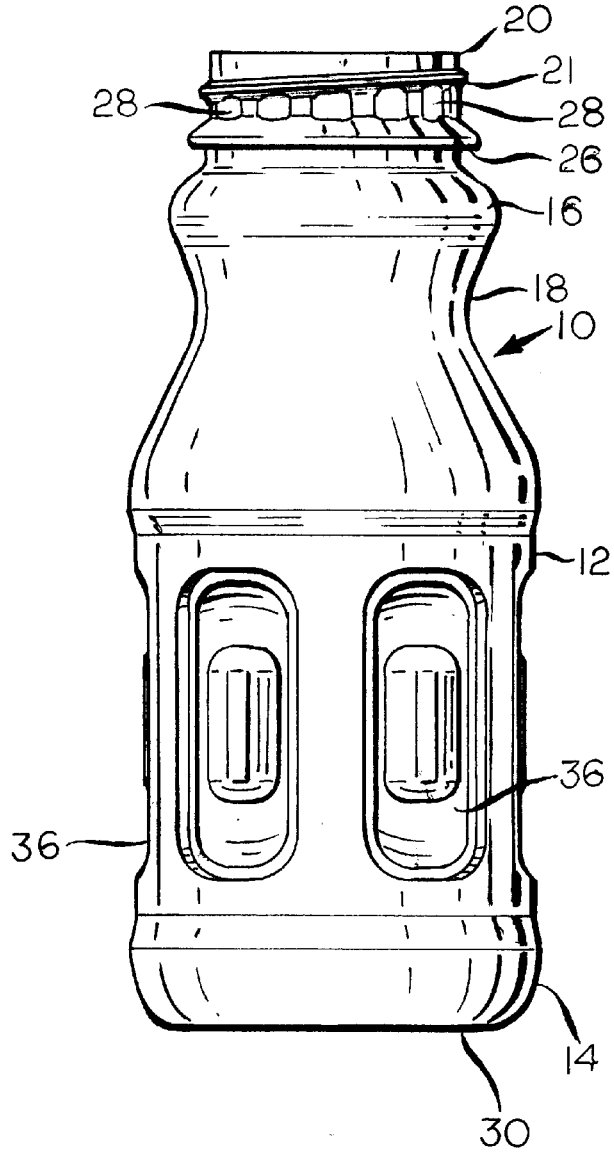

A container according to the preferred embodiment of the present invention is identified generally be reference numeral 10 in the drawing. The container 10 is blown in its illustrated configuration from an injection molded preform or parison of a suitable thermoplastic material or, preferably, from a multiplicity of layers of various thermoplastic materials as will be hereinafter described in more detail, in a conventional manner. The container 10 has a generally cylindrical body portion 12, to which a double ended label, not shown, may be applied, with bulbous heel and shoulder portions 14, 16, respectively, above and below the body portion 12.

Figure 9:
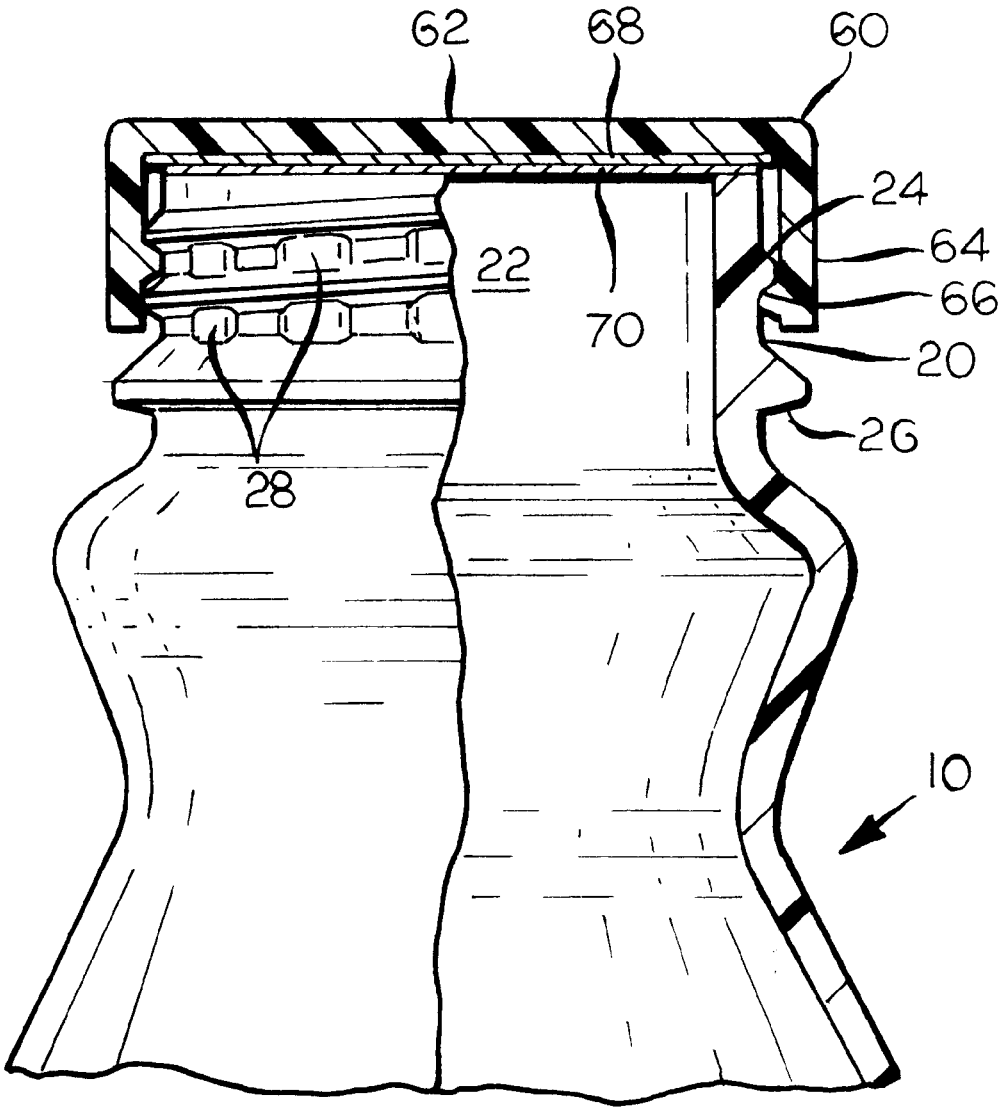
FIG. 9 is a fragmentary elevation view, partly in cross-section and at an enlarged scale, of the container of FIGS. 1–7 after filling, sealing and capping.

Extending upwardly from the shoulder portion 16 is an hourglass-shaped neck portion 18, and a closure-receiving finish portion 20 that extends upwardly from the neck portion 18 to a rim at an upper limit of the container 10. The finish portion 20 surrounds an opening 22 through which a liquid, for example, a fruit juice or other beverage (not shown), may be introduced into, or removed from, the container 10. The finish portion 20 is provided with an externally projecting and helically extending thread 24 by which a complimental internally helically threaded closure 66 (FIG. 9) may be removably applied to the container 10 after it has been filled (except for a customary headspace) with the beverage to be packaged therein. As shown, for example, in FIGS. 2, 3, 6 and 9, the arcuate extent of the helical thread 24 is substantially greater than 360° to ensure good closing contact between the container 10 and the closure 60. In any case, the finish portion 20 of the container 10 is also preferably provided with an outwardly projecting ring 26 at a location below the thread 24, to permit the container 10 to be supported on the ring 26 during filling and capping and thereby avoid the imposition of compression loads on the portions of the container 10 below the ring 26. Further, to impart improved compression strength to the finish portion 20 of the container 10 during filling and capping, the finish portion 20 may be provided with a circumferentially spaced apart series of outwardly projecting columns 28 at various locations underlying the flights of the thread 24, as is generally described in commonly-assigned U.S. Pat. No. 6,105,800 (Czesak), the disclosure of which is also incorporated by reference herein.

Figure 5:
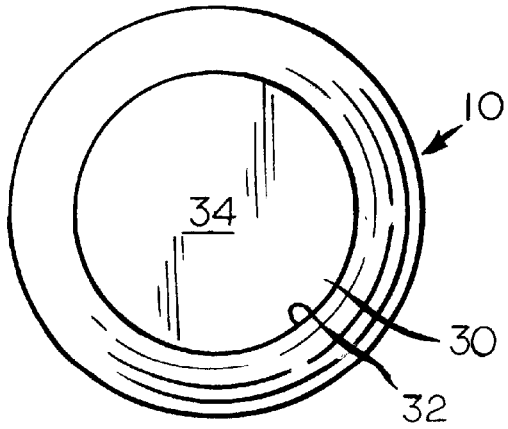
FIG. 5 is a bottom plan view of the container of FIGS. 2, 3, 4 and 6.
Figure 7:
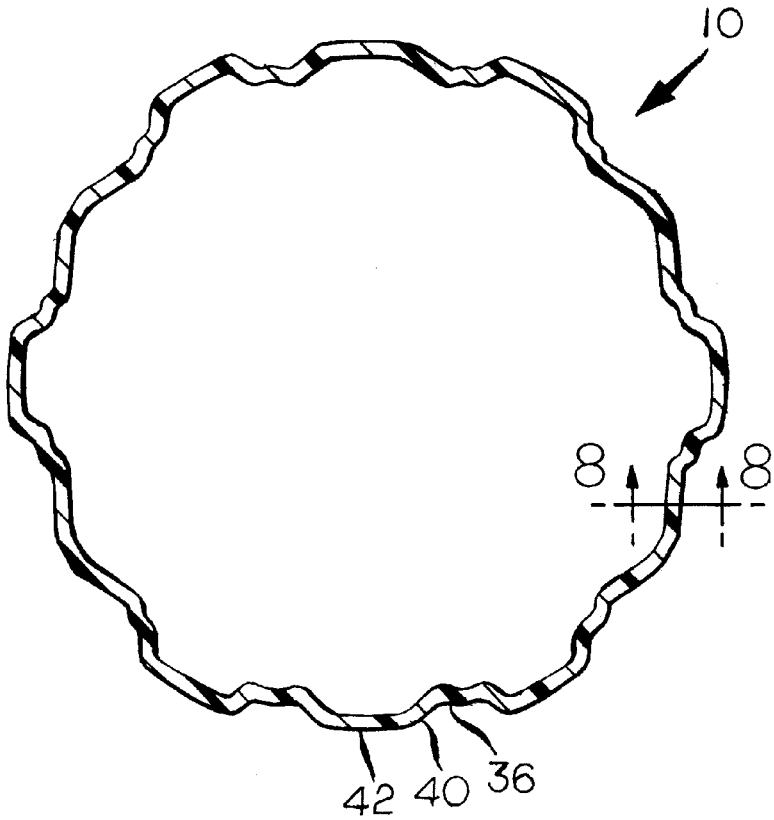
FIG. 7 is a sectional view, at an enlarged scale, taken on line 7—7 of FIG. 2.

The container 10 is also provided with a closed bottom 30 with a radially outermost annular bearing ring 32 surrounding an upwardly recessed central portion 34 (FIG. 5). The bearing ring 32 constitutes the lowermost portion of the container 10 when it is positioned in an upright orientation and provides a supporting surface by which a filled container 10 may stand upright on a table or shelf. It is to be noted that no portion of the central portion 34 of the closed bottom 30 needs to be provided with outwardly projecting and radially extending ribs, such as those that are characteristic of prior art hot-filled container bottoms, even if the container 10 is to be filled with a heated beverage, if the primary load bearing material of the container 10 is PPE, because of good hot strength characteristics of PPE at typical hot-fill temperatures, for example, approximately 180° F.

When the container 10 is to be filled with a heated liquid and capped while the liquid is still hot, the body panel 12 of the container 10 is provided with a spaced plurality of oblong-shaped vacuum panels 36 to accommodate deflections of the body panel 12 under the negative pressure that will otherwise develop as the hot-filled beverage cools. Each vacuum panel 36, which has a substantially greater height than width, contains a recessed annular portion 38 surrounded by a partly recessed shelf portion 40 with an oblong-shaped raised island portion 42 projecting outwardly from a central interior of the recessed portion 38.

Figure 8:
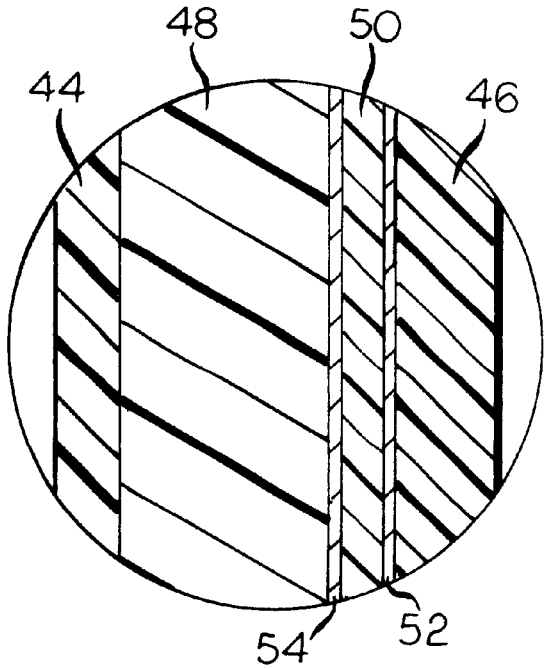
FIG. 8 is a cross-sectional view, at a substantially enlarged scale, taken on line 8—8 of FIGS. 7.

As is shown in FIG. 8 and as heretofore generally described, the container 10 is formed from a parison with co-extruded multiple layers of suitable materials combined to take optimal advantage of properties of different materials. For the hot filling of an oxygen-sensitive product, the container 10 is preferably formed with radially innermost and outermost layers 44, 46, respectively, of virgin PPE, and a main structural layer 48 that is made up of reground scrap material (mostly PPE), and mixed with virgin PPE if and to the extent needed, in direct contact with and directly bonded to the layer 44. To inhibit the migration of oxygen into the container 10, the container 10 is also provided with a layer of EVA 50 or other extrudable material with good oxygen-barrier properties between the layers 46, 48. Because EVA does not extrusion bond very well to PPE, the layer 50 is separated from the layers 46, 48, by layers 52, 54, respectively, of an adhesive that is effective to bond both to PPE and EVA. This wall construction corresponds to that used in commercial embodiments of the container depicted in U.S. Pat. No. 445,036 (Goettner et al.).

To provide tamper indicating properties to the container 10, after filling, a rim at a free end of the finish portion 20 of the container 10 may have a film-type seal 70 adhesively sealed to the rim before application of the closure 60 to the finish 20 of the container 10. Breaking of the seal 70, which must be done for access to the contents of the container 10, is a visible indication of a prior opening or attempted opening of the filled container 10. Of course, it is also contemplated that tamper-indicating properties can be imparted to a package incorporating a filled container 10 by providing the closure 60 with a depending, tamper-indicating band that engages outwardly projecting structure on the finish 20 on the container 10, to separate from the portion of the closure 60 thereabove upon an attempted opening of the package, as is known in the packaging art.

The closure 60 may be of conventional metallic or thermoplastic construction, and, when produced from a thermoplastic material by injection or compression molding, has a central panel 62 which, when applied, overlies the rim at the top of the finish portion 20 of the container 10. The closure 60 also has an annular skirt 64 that extends downwardly from a periphery of the central panel 62 to surround an upper portion of the finish portion 20 of the container 10, and a helical thread 66 that projects inwardly from the skirt 64 to engage the thread 24 of the finish portion 20 of the container 10, to thereby permit the closure 60 to be closingly applied to the container 10 by a turning action and to be removed from the container 10 by a reverse turning action. The closure 60 may also be provided with a separate sealing liner 68 to form a liquid-tight seal with the sealing film 70, or with the rim at the top of the finished portion 20 of the container 10 after removal of the sealing film 70, in a known manner. Of course, the use of a closure 60 with an integral sealing fin in place of the sealing liner 68 is also contemplated.

For a container 10 with an internal capacity suited for packaging 8 fl. oz of a heated beverage, a suitable container will have an overall height of approximately 5.51 in., a max O.D. of approximately 2.27 in. (for a height diameter ratio of slightly less than 2.0), 6 spaced vacuum panels 36 and an average wall thickness of approximately 0.33 in., of which approximately 3.0% is the thickness of the EVA layer.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

We claim:

1. A blown, hot-fillable container for packaging a single serve quantity of a beverage, such container being formed from a co-extruded parison with a multiplicity of layers of a thermoplastic materials and comprising:

a closed bottom;

a generally cylindrical central portion;

a bulbous heel joining said closed bottom and said central portion, said bulbous heel projecting radially outwardly beyond said central portion;

a bulbous shoulder portion at an opposed end of said central portion and projecting radially outwardly beyond said central portion;

a closure-receiving finish portion at a free end of said container; and an hourglass-shaped portion joining said shoulder portion and said finish portion;

said enclosed bottom being free of radial strengthening ribs; and said central portion being provided with a spaced apart plurality of oblong-shaped vacuum panels to accommodate any shrinkage of the container under negative pressure resulting from capping and sealing said container with a hot-filled beverage therein while the beverage is still hot;

wherein said plurality of vacuum panels consists of six vacuum panels each having a substantially greater height than width.

2. A container according to claim 1 wherein said multiplicity of layers comprises:

innermost and outermost layers of virgin PPE;

a main structural layer comprising reground material of other like containers with or without virgin PPE mixed therein;

said structural layer being bonded to one of said innermost and outermost layers;

a layer of an oxygen-barrier material positioned between said structural layer and the other of said innermost and outermost layers; and first and second layers of adhesive between said layer of barrier material and said main structural layer, and between said layer of barrier material and said other of said innermost and outermost layers, respectively, and joining said layer of oxygen-barrier material to said main structural layer and said other of said innermost and outermost layers.

3. A container according to claim 2 wherein:

said one of said innermost and said outermost layers is said innermost layer.

4. A container according to claim 3 wherein:

said layer of oxygen-barrier material consists mainly of EVA.

5. A container according to claim 4 wherein:

said container has an average wall thickness of approximately 0.33 in., and said layer of barrier material has a thickness that represents approximately 3.0% of said average wall thickness.

6. A container according to claim 5 wherein:

said container has an overall height to maximum diameter ratio of approximately 2.0, and an internal capacity of approximately 8 fl. oz.

7. A container according to claim 6 wherein:

said finish portion is sized to receive a 38 m.m. closure.

8. A package comprising hot-fillable container for packaging a single serve quantity of a beverage, said container being formed from a co-extruded parison with a multiplicity of layers of a thermoplastic materials and comprising:

a closed bottom;

a generally cylindrical central portion;

a bulbous heel joining said closed bottom and said central portion, said bulbous heal projecting radially outwardly beyond said central portion;

a bulbous shoulder portion at an opposed end of said central portion and projecting radially outwardly beyond said central portion;

a closure-receiving finish portion at a free end of said container, and an hourglass-shaped portion joining said shoulder portion and said finish portion;

said enclosed bottom being free of radial strengthening ribs; and a closure removably closing said container after hot-filling said container with the beverage;

said central portion of said container being provided with a spaced apart plurality of oblong-shaped vacuum panels to accommodate any shrinkage of the container under negative pressure resulting from capping and sealing said container with a hot-filled beverage therein while the beverage is still hot;

wherein said plurality of vacuum panels of said container consists of six vacuum panels each having a substantially greater height than width.

9. A package according to claim 8 wherein:

said closure is a 38 m.m. closure.

10. A package according to claim 8 and further comprising:

a sealing film directly bonded to a rim at the free end of the container, said sealing fin underlying a top central panel of said closure.

11. A package according to claim 8 wherein said multiplicity of layers of said container comprises:

innermost and outermost layers of virgin PPE;

a main structural layer comprising reground material of other like containers with or without virgin PPE mixed therein;

said structural layer being bonded to one of said innermost and outermost layers;

a layer of an oxygen-barrier material positioned between said structural layer and the other of said innermost and outermost layers; and first and second layers of adhesive between said layer of barrier material and said main structural layer, and between said layer of barrier material and said other of said innermost and outermost layers, respectively, and joining said layer of oxygen-barrier material to said main structural layer and said other of said innermost and outermost layers.

12. A package according to claim 11 wherein:

said one of said innermost and said outermost layers of said container is said innermost layer.

13. A package according to claim 12 wherein:

said layer of oxygen-barrier material of said container consists mainly of EVA.

14. A package according to claim 13 wherein:

said container has an average wall thickness of approximately 0.33 in., and said layer of barrier material has a thickness that represents approximately 3.0% of said average wall thickness.

15. A package according to claim 14 wherein:

said container has an overall height to maximum diameter ratio of approximately 2.0, and an internal capacity of approximately 8 fl. oz.

* * * * *

UNITED STATES PATENT AND TRADEMARK OFFICE

CERTIFICATE OF CORRECTION

PATENT NO. : 6,554,146 B1
APPLICATION NO. : 10/052050
DATED : April 29, 2003
INVENTOR(S) : Jamie W. DeGroff et al.

It is certified that error appears in the above-identified patent and that said Letters Patent is hereby corrected as shown below:

On the title page item (57),
ABSTRACT, line 15, change "(5)" to -- (50) --.

Claim 1, line 4, change "materials" to -- material --.

Claim 8, line 1, before "hot-fillable" insert -- a --.

Claim 8, line 4, change "materials" to -- material --.

Signed and Sealed this

Fifth Day of December, 2006

JON W. DUDAS
*Director of the United States Patent and Trademark Office*